United States Patent [19]

Furlong et al.

[11] Patent Number: 4,599,008

[45] Date of Patent: Jul. 8, 1986

[54] FINGERNAIL POLISH CAPSULE AND PLUNGER

[75] Inventors: Patrick J. Furlong, Carlsbad; Jack R. Evers, Coronado; Brian R. Pike, Carlsbad, all of Calif.

[73] Assignee: FIN-TECH Limited Partnership, Tucson, Ariz.

[21] Appl. No.: 750,077

[22] Filed: Jun. 28, 1985

[51] Int. Cl.[4] ..... A46B 11/02

[52] U.S. Cl. ..... 401/133; 401/134; 401/135; 401/176; 401/182; 132/74.5

[58] Field of Search ..... 401/176, 182, 132, 133, 401/134, 135; 132/74.5

[56] References Cited

U.S. PATENT DOCUMENTS

| | | | |
|---|---|---|---|
| 1,671,125 | 5/1928 | Pollock | 401/134 |
| 2,293,211 | 8/1942 | Moreau | 401/176 |
| 2,978,722 | 4/1961 | Kusakabe | 401/176 |
| 3,720,473 | 3/1973 | Nakata | 401/134 X |
| 3,739,779 | 6/1973 | Pfleger | 401/134 X |

FOREIGN PATENT DOCUMENTS

| | | | |
|---|---|---|---|
| 337676 | 1/1922 | Fed. Rep. of Germany | 401/135 |

*Primary Examiner*—Steven A. Bratlie

*Attorney, Agent, or Firm*—Charles E. Brown; Charles A. Brown

[57] ABSTRACT

This relates to a fingernail polish cartridge and dispenser. This will be provided as a sealed unit which may be readily placed in a reusable handpiece and wherein there is associated with a cartridge containing the polish a brush attachment and a plunger. When the brush attachment is moved into the cartridge by way of the handpiece, it will automatically open one end of the cartridge, that end being closed by a separately formed plug which has a sealed fit therein. Then a plunger is utilized to displace a removable panel at the opposite end of the cartidge followed by that removable panel seating on a piston and being moved into the cartridge by further movement of the plunger so as to force the liquid nail polish into the brush attachment.

16 Claims, 6 Drawing Figures

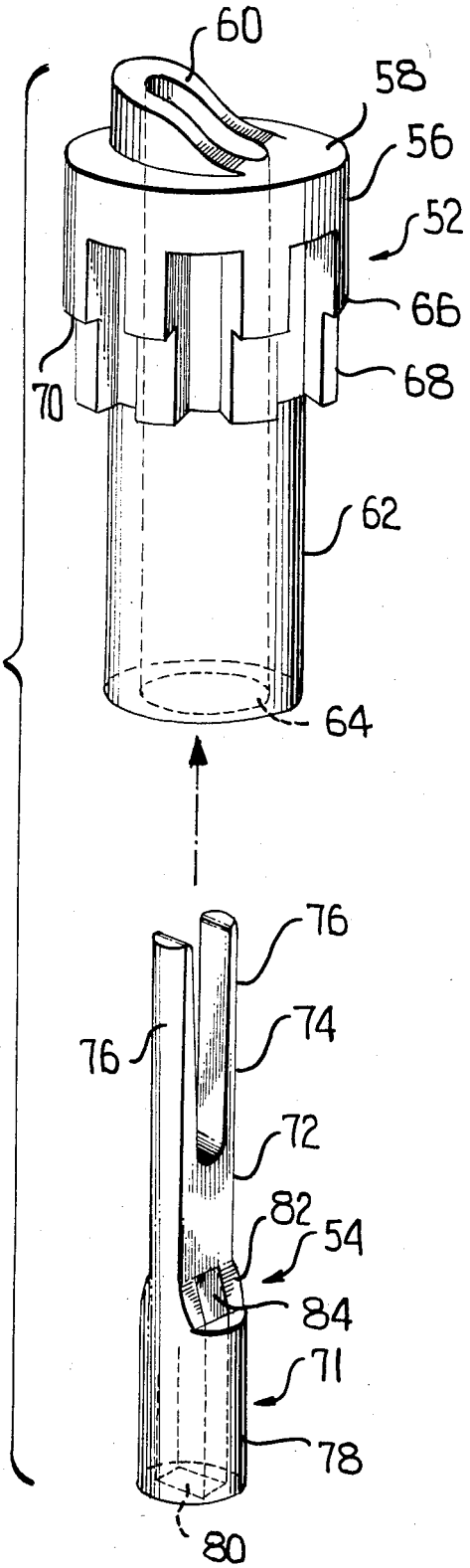
FIG.5
FIG.6
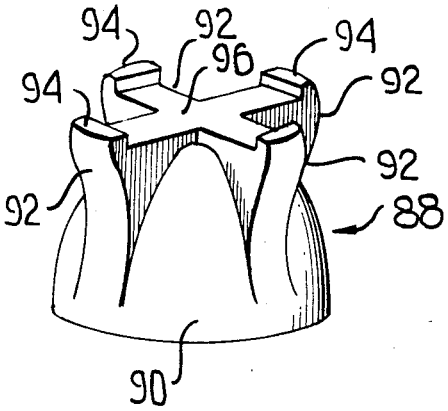

FINGERNAIL POLISH CAPSULE AND PLUNGER

This invention relates in general to new and useful improvements in disposable product packages, and more particularly a disposable nail polish cartridge and brush assembly.

Nail polish is customarily sold in bottles with the closure cap having attached thereto the brush which is used to apply the polish. The contents of such bottles are much more than that required for a single application of the polish with the result that after an application, the bottle must be reclosed. Women have relied upon various techniques for storing the bottles including placing them in refrigerators. However, there has been no true solution to solvent loss. In fact, there is a solvent loss in the customary nail polish bottle arrangement during storage.

This invention relates to a compact cartridge and brush arrangement which may be mounted in a suitable holder and wherein the cartridge contains enough nail polish for a single application.

More particularly, the cartridge is sealed so that the loss of solvent before the cartridge is opened is a minimum and a conservative projected shelf life at room temperature would be seven and a half years.

With the above and other objects in view that will hereinafter appear, the nature of the invention will be more clearly understood by reference to the following detailed description, the appended claims, and the several views illustrated in the accompanying drawings.

FIG. 5 is an enlarged exploded perspective view showing the primary components of the brush assembly and the constructional details thereof.

FIG. 6 is a top perspective view of the piston and shows the details of the seat for receiving the removable end panel of the cartridge.

Figure 1:
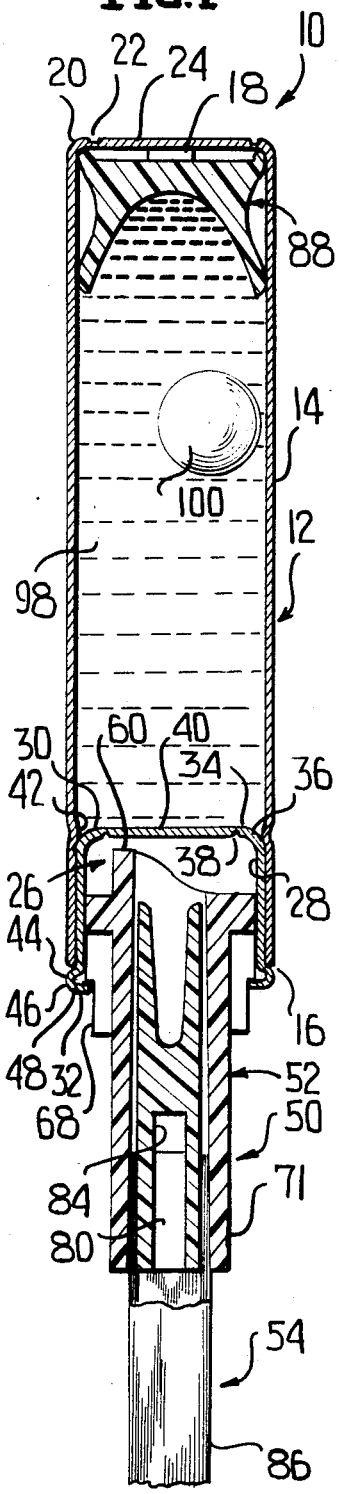
FIG. 1 is a longitudinal sectional view taken through the nail polish cartridge and brush assembly as distributed and prior to opening.

Referring now to the drawings in detail, it will be seen that there is illustrated in FIG. 1 a single use, disposable, unit package, with brush formed in accordance with this invention, the package being generally identified by the numeral 10. The package 10 includes a deep drawn cartridge, generally identified by the numeral 12. The cartridge 12 is formed of metal and is somewhat similar to the cartridge of a firearm unit. The cartridge 12 includes a body 14 having an open end 16 and a closed end 18. The closed end 18 is defined by an end panel 20 which has a weakening line 22 formed therein defining a removable panel portion 24.

The open end 16 of the cartridge 12 is closed by a plug generally identified by the numeral 26. The plug 26 is also formed of metal and is of a deep drawn construction. The plug 26 includes a cylindrical body 28 having a closed end 30 and an open end 32. The closed end 30 includes an end panel 34 which is joined to the body 28 by a corner 36. The panel 34 has formed on the inner surface thereof a line of weakening 38 which defines a removable panell portion 40.

It is to be understood that the body 28 of the plug 26 is of an external diameter such s to be press fitted within the cartridge body 14 in sealed relation. Preferably this seal is enhanced by a radially inwardly directed bead 42 which is formed in the cartridge body 14 and engaged by the corner 36 in a manner to deform the bead 42. The bead 42, in conjunction with the corner 36, also defines means for limiting the telescoping of the plug 26 into the cartridge 12.

At the open end 32 of the plug 26, there is a radially outwardly projecting lip 44 which carries a reversely turned portion 46 which, in turn, terminates in a radially inwardly directed flange 48. The lip 44 abuts against the free end of the cartridge body 14 and further serves to limit movement of the plug 26 into the cartridge body 14.

The plug 26 carries a brush assembly generally identified by the numeral 50. The brush assembly 50 includes a head or holder 52 and a separately formed brush unit 54. These are best shown in FIG. 5.

The holder 52 is of a molded plastic construction and includes a tubular piston portion 56 at one end thereof. The piston portion 56 has an end wall 58 and there is projecting from the end wall 58 a tubular ramp 60. A tubular extension 62 extends from the other end of the piston portion 58 with the tubular extension 62 having a bore 64 extending therethrough, the bore 64 also extending through the piston portion 56 and into the ramp 60.

The piston portion 56 is provided with circumferentially spaced extensions in the form of guide elements 66. The guide elements 66 are axially elongated in the direction of the tubular extension 62 and have end portions 68 which are of a reduced diameter so as to define shoulders 70 on the fingers.

Referring now to FIG. 1, it will be seen that when the head or holder 52 is assembled with the plug 26, the flange 32 abuts the shoulder 70 and retains the holder 52 within the plug 26. However, the lower portions 68 of the fingers extend out through the open end of the plug 26 for a purpose to be described hereinafter. At this time it is also pointed out that the ramp 60 is disposed adjacent to, but spaced from the end panel 34.

The brush portion 54 includes a brush insert which is generally identified by the numeral 71. The brush insert 71 is of a molded plastic construction and includes a rectangular cross sectional upper portion 72 having a generally U-shaped relief 74 to define a pair of legs 76. The lower portion 78 of the brush insert 71 is of a circular cross section and has a rectangular cross sectional passage formed therein. The lower portion converges into the rectangular cross sectional upper portion in sloping portions 82 having openings 84 therein which form the upper part of the opening or passage 80.

A circle of bristles 86 extend into the bore 80 around the brush insert and project from the holder 52.

The cartridge 12 carries a piston which is generally identified by the numeral 88. As is best shown in FIG. 6, the piston 88 is primarily of a hemispherical construction and includes a hemispherical lower part 90. A plurality of guide fingers 92, which are circumferentially spaced, project upwardly and radially outwardly from the hemispherical portion 90 and are integrally formed therewith. The guide fingers 92 terminate in tips 94 which define therebetween a generally cross shaped seat 96.

It is to be understood that in the formation of the device, the piston 88 will be first placed within the cartridge 12 followed by a steel ball 100 and thereafter fingernail polish 98 will be placed in the cartridge followed by the insertion of the plug 26.

The ball 100 is used to make certain that the polish is well mixed. The ball is positioned within the cartridge 12 as shown.

It is intended that the unit be utilized in conjunction with a reusable handpiece which is generally identified by the numeral 104 and is only schematically illustrated.

The handpiece 104 comes with a plunger 102 which may be in the form of an elongated rod.

Figure 2:
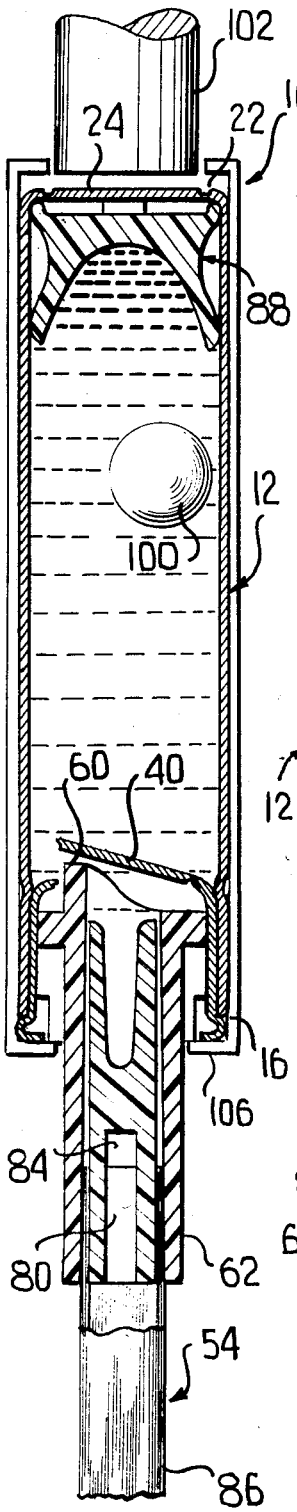
FIG. 2 is a sectional view similar to FIG. 1 but shows the nail polish cartridge mounted within a reusable handpiece and wherein the brush assembly has been shifted relaltive to the cartridge by the holder to open the cartridge to the brush assembly.

As is clearly shown in FIG. 1 and previously described, the lower portions 68 of the fingers 66 of the brush holder 52 project through the opening defined by the flange 32. When the unit is placed within the handpiece 104, a lower part 106 of the handpiece engages the ends of the finger lower portions 68 and forces the holder 52 up into the plug 26 to the extent that the ramp 60 forcefully bears against the removable panel portion 40 and displaces the same automatically, as is shown in FIG. 2. The interior of the cartridge 12 and the polish 98 disposed therein is now open to the brush attachment 50 for supplying the bristles 86.

Figure 3:
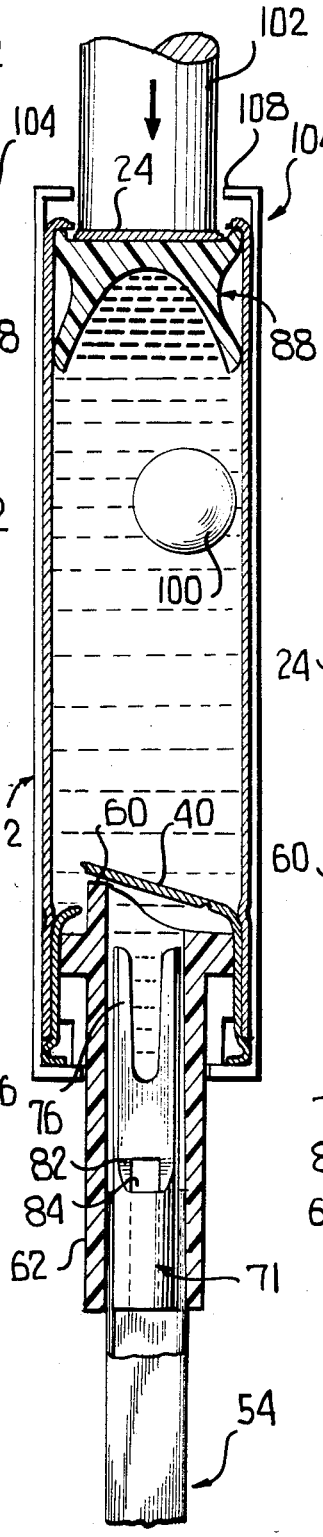
FIG. 3 is another sectional view similar to FIG. 2, but shows a plunger asociated with the handpiece and the cartridge and being positioned to open the normally closed end of the cartridge and for actuating a piston within the cartridge to force the nail polish from within the cartridge into the brush assembly.

In order to force the polish out of the cartridge 12, the plunger 102 is now utilized in the manner shown in FIG. 3 to bear against the removable panel portion 24 and displace the same axially inwardly as is shown in FIG. 3. The displaced removable panel portion 24 engages the seat 96 of the piston 88 and remains seated therein as the piston 88 is forced axially through the cartridge in the manner shown in FIG. 4.

Figure 4:
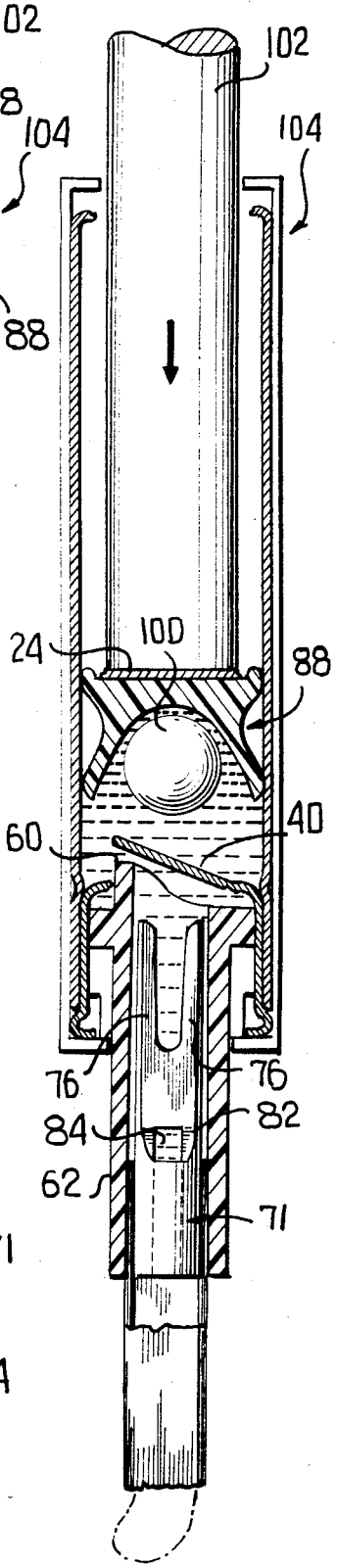
FIG. 4 is another sectional view similar to FIG. 3 which shows the plunger well advanced into the cartridge.

It is to be noted that the handpiece 104 has an upper portion 108 which functions as a guide for the plunger 102 as is clearly shown in FIG. 4. In fact, it is feasible to have a ratchet type interlock between the handpiece 104 and the plunger 102 so as to indicate to a user the amount of movement of the plunger. This would also serve to hold the plunger in its projected position.

The handpiece will be designed so as to be conveniently held by a user with there being a balance so that the bristles 86 will have a tendency to be lowermost.

After one's nails have been coated in the usual manner, the unit will be displaced from the handpiece and discarded.

Although only a preferred embodiment of the invention has been specifically illustrated and described herein, it is to be understood that minor variations may be made in the unit without departing from the spirit and scope of the invention as defined by the appended claims.

We claim:

1. A combination brushable product dispenser and brush assembly comprising a tubular cartridge having an integral closed end and an open end, said closed end including an end panel having formed therein a weakening line defining a first removable panel portion, a plug having a forced fit in said cartridge open end and sealing said cartridge open end, said plug having an integral closed end and an open end, said plug closed end being within said cartridge and opposing said cartridge closed end, said plug closed end including an end panel having formed therein a weakening line defining a second removable panel portion, cooperating means on said cartridge and said plug limiting telescoping of said plug into said cartridge, a piston within said cartridge adjacent said cartridge closed end, said brush assembly including a head trapped within said plug for relative axial movement and a projecting brush portion, said head including an axial projection forming means for displacing said second removable panel portion from said plug closed end into said cartridge and to open said cartridge to said brush portion, and a plunger forming means for first displacing said first removable panel portion from said cartridge closed end into said cartridge and then advancing said piston towards said plug to dispense a liquid from within said cartridge into said head to said brush portion.

2. A combination according to claim 1 together with a handpiece for receiving said combination, said handpiece including a generally tubular body having opposite partially closed ends spaced apart greater than cartridge closed end and said plug open end, and being axially movable relative to said cartridge to engage and axially move said head relative to said plug to effect said displacement of said second removable panel portion.

3. A combination according to claim 2 wherein said head projects out through said plug open end for positioning by said handpiece.

4. A combination according to claim 2 wherein that end of said handpiece positioned adjacent said cartridge closed end forms guide means for said plunger.

5. A combination according to claim 1 wherein said piston has an end opposing said cartridge closed end, and said piston end has a seat for receiving said first removable panel portion.

6. A combination according to claim 1 wherein said piston has an end opposing said cartridge closed end, and said piston end has a seat for receiving said first removable panel portion, said seat being defined by upstanding fingers.

7. A combination according to claim 6 wherein said piston is generally hemispherical, and said fingers are in the form of butresses extending from an exterior surface of said piston.

8. A combination according to claim 1 wherein said head has a tubular ramp member for engaging said second removable panel portion and displacing said second removable panel portion out of said plug closed end to provide access to the interior of said cartridge.

9. A combination according to claim 8 wherein said head has a tubular extension on the side thereof remote from said ramp and in communication with said ramp for supplying a product from within said cartridge to said brush portion, and said brush portion includes a hollow stem telescoped in said tubular extension.

10. A combination according to claim 9 wherein said head includes a piston portion.

11. A combination according to claim 1 wherein said brush portion includes a hollow stem and said head is in the form of a tubular holder receiving said hollow stem.

12. A combination according to claim 1 wherein said head is in the form of a holder for said brush portion and includes a piston portion sealable to said plug.

13. A combination according to claim 12 wherein remote from said plug closed end said holder is radially inwardly stepped remote from said closed end to define a sholder, and said plug has a radially inwardly directed flange for engaging said shoulder and retaining said holder within said plug.

14. A combination according to claim 1 wherein said cooperating means includes a radially inwardly projecting head on said cartridge and a corner of said plug.

15. A combination according to claim 1 wherein said cooperating means includes a radially outwardly projecting lip on said plug at said plug open end engaging said cartridge open end.

16. A combination according to claim 15 wherein said plug has a flange extending radially inwardly from said lip for effecting said retention of said head in said plug.

* * * * *